US007017785B2

(12) United States Patent
Lasserre et al.

(10) Patent No.: US 7,017,785 B2
(45) Date of Patent: Mar. 28, 2006

(54) PRODUCT DISPENSING HEAD AND PACKAGING WITH VARIABLE FLOW

(75) Inventors: Pierre-Andre Lasserre, Coubron (FR); Marcel Sanchez, Aulnay-Sous-Bois (FR); Guiseppe Dalsant, Baselga Di Pine (IT)

(73) Assignee: L'Oreal, Paris (FR)

( * ) Notice: Subject to any disclaimer, the term of this patent is extended or adjusted under 35 U.S.C. 154(b) by 335 days.

(21) Appl. No.: 10/626,690

(22) Filed: Jul. 25, 2003

(65) Prior Publication Data

US 2005/0121474 A1 Jun. 9, 2005

Related U.S. Application Data

(60) Provisional application No. 60/407,297, filed on Sep. 3, 2002.

(30) Foreign Application Priority Data

Jul. 25, 2002 (FR) ..... 02 09448

(51) Int. Cl.
*B65D 83/00* (2006.01)

(52) U.S. Cl. ..... 222/402.13; 222/182; 222/153.11; 222/402.23

(58) Field of Classification Search ..... 222/402.13, 222/182, 402.1, 570, 402.23, 402.21, 402.14, 222/402.22, 402.15, 153.11, 153.12, 153.13, 222/153.14, 402.25, 402.11
See application file for complete search history.

(56) References Cited

U.S. PATENT DOCUMENTS

| | | | | |
|---|---|---|---|---|
| 2,887,273 | A | 5/1959 | Anderson et al. | |
| 3,363,968 | A | 1/1968 | Williams | |
| 3,703,994 | A | 11/1972 | Nigro | |
| 3,870,205 | A | 3/1975 | Bucaro | |
| 5,503,303 | A * | 4/1996 | LaWare et al. | 222/153.12 |
| 5,649,645 | A * | 7/1997 | Demarest et al. | 222/153.07 |
| 5,918,780 | A | 7/1999 | Tanaka | |
| RE38,022 | E * | 3/2003 | De Laforcade | 222/182 |
| 2005/0184093 | A1 * | 8/2005 | Brunerie et al. | 222/153.11 |

* cited by examiner

*Primary Examiner*—Frederick C. Nicolas
(74) *Attorney, Agent, or Firm*—Oblon, Spivak, McClelland, Maier & Neustadt, P.C.

(57) ABSTRACT

A package for dispensing a product and a dispensing head for such a package are provided. In an illustrated form, the dispensing head has an axis X, designed to actuate a dispensing element mounted on a receptacle to dispense a product contained in the receptacle. A dispensing conduit is capable of communicating with the product inside the receptacle and has at least two passages of different cross-sections. In a preferred form, the conduit is molded as a single piece with the arrangement attaching the head to the receptacle integral therewith via a deformable connection. An actuator arrangement is provided to actuate the dispensing element and to cause the conduit to communicate with the inside of the receptacle, with a dispensing orifice formed at the extremity of a channel preferably having a length greater than the diameter of the dispensing orifice. The actuating arrangement is movable relative to the conduit between at least two positions, a first position in which the dispensing orifice communicates with one of the passages, and a second position in which the dispensing orifice communicates with the other passage.

51 Claims, 5 Drawing Sheets

PRODUCT DISPENSING HEAD AND PACKAGING WITH VARIABLE FLOW

CROSS-REFERENCE TO RELATED APPLICATIONS:

This document claims priority to French Application No. 02 09448, filed Jul. 25, 2002 and U.S. Provisional Application No. 60/407,297, filed Sep. 3, 2002, the entire content of which is hereby incorporated by reference.

FIELD OF THE INVENTION

The present invention relates to a product dispenser and packaging in which a dispensing head for the product is designed to actuate a dispensing element mounted on a receptacle, preferably a valve mounted on a pressurized container, for dispensing a product contained in the receptacle. In particular, the invention provides a dispensing head enabling the product to be dispensed with at least two different flowrates.

BACKGROUND OF THE INVENTION

Discussion of Background

Dispensing heads of the general type to which the invention pertains are known, notably in U.S. Pat. Nos. 3,363,968 and 3,703,994.

The dispensing head described in U.S. Pat. No. 3,363,968 utilizes a collar attached to the receptacle and a push button which moves axially to actuate a valve stem. The push button is mobile in rotation relative to the collar between two dispensing positions delivering two different flow-rates. To this end, the push button is penetrated transversely by a conduit which terminates at its two extremities by apertures of different cross-sections. When the push button is pressed, the conduit is designed to be aligned with a channel, formed in the collar, which emerges via a dispensing aperture. The user places the push button at an angle relative to the collar such that one or the other of the apertures in the conduit is aligned with the channel so as to dispense the product at the selected flow-rate when the push button is pressed.

The dispensing head described in U.S. Pat. No. 3,703,994 utilizes a collar designed to move axially relative to the receptacle in response to the depression of a push button mounted on the collar and designed to actuate a valve. The push button is also mobile in rotation relative to the collar between three dispensing positions delivering three different flow-rates. The collar incorporates an axial conduit which communicates with the inside of the receptacle, when the valve is actuated, and which emerges laterally via three apertures of different cross-sections, with each of the apertures emerging above an element termed the "centerpost." The push button includes a spray nozzle which, in each dispensing position, is aligned with a centerpost. A conduit of complementary shape is integral with the push button and is inserted into the conduit in the collar. The conduit in the push button incorporates an axial slot which, in each dispensing position of the push button, is aligned with one of the apertures. However, the necessary clearance between the nozzle and each centerpost to allow the push button to rotate between the three positions prevents the nozzle from being correctly positioned at each centerpost so that it is difficult to obtain a good spray. Furthermore, such a clearance makes it impossible to align the nozzle in an identical manner with the different centerposts so that it is very difficult to obtain a reproducible spray for one or more of the positions. Furthermore, the conduit connecting the valve to the nozzle defines a relatively large volume so that, after the user has released the push button, all of the product remaining in this volume is dispensed.

U.S. Pat. No. 2,887,273 also describes a dispensing head incorporating a diffuser attached to the receptacle and to the valve stem, and a push button designed to actuate the valve stem. The push button is mobile in rotation relative to the diffuser in two dispensing positions delivering two different flow-rates. To this end, the diffuser incorporates two diametrically opposed spray orifices of different cross-section, and the push button has an aperture in its wall designed to align with one or other of the spray orifices. When the push button aperture is aligned with one of the orifices, the other orifice is blanked off by a wall of the push button. This configuration requires two spray orifices which complicates the manufacture of the dispensing head as such orifices are more difficult to make than a simple hole.

SUMMARY OF THE INVENTION

It is an object of the invention to provide a dispensing head which can avoid one or more, preferably all, of the drawbacks of the prior art.

A further object of the invention is to provide a new dispensing head enabling a product to be dispensed with at least two different flow-rates.

Another object of the invention is also to provide a dispensing head that is simple and inexpensive to produce.

A further object of the invention is to provide a dispensing head that is capable of switching readily from one dispensing position to another dispensing position.

According to the invention, the above and other objects can be achieved by providing a dispensing head having an axis X designed to actuate a dispensing element mounted on a receptacle and to dispense a product contained in the receptacle. The head includes an arrangement (or first assembly) to attach the head onto the receptacle. A dispensing conduit is capable of communicating with the product inside the receptacle, and includes at least two passages of different cross sections. In accordance with an example of a preferred form, the conduit can be formed by molding from a single piece with the attachment arrangement integral therewith via a deformable connection arrangement. The assembly is also arranged to actuate the dispensing element and to cause the conduit to communicate with the inside of the receptacle. The actuating arrangement provides a second assembly. The actuating arrangement has a dispensing orifice formed at the extremity of a channel with a length greater than the diameter of the dispensing orifice, with the actuating arrangement being mobile relative to the conduit between at least two positions. In a first position the dispensing orifice communicates with one of the passages, and in a second position the dispensing orifice communicates with the other passage (or another of the passages where more than two are provided).

The objects of the invention can also be achieved by a dispensing head having an axis X and designed to actuate a dispensing element mounted on a receptacle and to dispense a product contained in the receptacle. This arrangement includes an arrangement to attach the head onto the receptacle. A dispensing conduit is capable of communicating with the product inside the receptacle, and has at least two passages of different cross-sections. By way of example, the conduit can be formed by molding as a single piece with the attachment arrangement integral therewith via a movable or deformable arrangement. An arrangement is also provided to actuate the dispensing element and to cause the conduit to communicate with the inside of the receptacle. The actuating arrangement includes a dispensing orifice defined by an attached nozzle, and is mobile relative to the conduit between at least two positions. In a first position the dispensing orifice communicates with one of the passages, and in a second position the dispensing orifice communicates with the other (or another) passage.

It is to be understood that passages of different cross-sections means passages which emerge to apertures having a different surface areas.

It is also to be understood that dispensing orifice means the diameter of the circle when the orifice is circular, or the diameter of the circle circumscribed within the cross-section of the orifice when the latter has a shape other than circular.

The presence of an elastically deformable connecting arrangement makes it possible to produce a conduit by a molding process from a single piece with the attachment arrangement, while being capable of moving relative to the attachment. Such a part is simple and inexpensive to produce.

Furthermore, the dispensing head is simple and inexpensive to make in that it requires only a single spray orifice formed in the actuating means, and in that the two passages of different cross-section are easy to produce as they can be formed during molding of the conduit. Advantageously, the connecting arrangement is preferably elastically deformable so that it reverts to an initial position when the load causing deformation is removed.

Advantageously, the attachment arrangement is preferably fixed axially on the receptacle in a manner such that the head is correctly held on the receptacle.

The connecting arrangement allows movement of the conduit in response to actuation. In a preferred embodiment, the connecting arrangement is formed by a transverse wall relative to axis X, with the wall corrugated. This configuration of the wall enables it to deform easily and to revert easily to its initial position.

The conduit has an axis X and includes a first extremity which carries the actuating arrangement and a second extremity capable of engaging with the dispensing element of the receptacle. Thus, the conduit directly transmits the pressure exerted on the actuating arrangement to the dispensing element.

The passages can be slots extending parallel to the axis X, which are of a different width and spaced at different angular positions. However, it is to be understood that any other form of passage can be used. The actuating arrangement is movable in a rotational direction about the axis X between the first and second positions.

In accordance with one example of the invention, the dispensing head can be advantageously configured so as to allow the dispensing element to be actuated only when the actuating arrangement is in the first and second positions. To this end, the dispensing head can include an axial stop against which the actuating arrangement bears when it is not in either of the first or second positions so as to prevent actuation of the dispensing element. Advantageously, the dispensing head can include at least two radial stops limiting the rotational movement of the actuating arrangement.

In accordance with another preferred option, the dispensing head can advantageously also include an arrangement to provide audible identification to indicate placement of the assembly in either of the first and second positions. The audible identification can be provided, for example, by the engagement of a first projection formed on the actuating arrangement and a second projection integral with the conduit, the first projection being capable, when the actuating arrangement moves relative to the conduit, of making contact with the second projection and elastically deforming the latter as it passes across it, thereby producing an audible signal. The dispensing head can also optionally include visual identification means to identify the first and second positions.

The invention also provides a packaging and dispensing unit for a product. The package includes a receptacle containing the product and is fitted with a dispensing element. In particular, a dispensing head as described above can be provided, and designed to actuate the dispensing element in order to dispense the product. The receptacle can be pressurized and the dispensing element can be a male valve incorporating a valve stem onto which the conduit is fitted, or a female valve, i.e., without a valve stem, into which the conduit is inserted. Alternatively, the receptacle can be at atmospheric pressure and equipped with a pump.

The invention is particularly useful for the packaging and dispensing of a cosmetic or personal care product, notably a hair product.

BRIEF DESCRIPTION OF THE DRAWINGS

Other objects, features and advantages of the invention will become apparent from the following detailed description, particularly when considered in conjunction with the drawings in which.

DETAILED DESCRIPTION OF THE PREFERRED EMBODIMENTS

Figure 1:
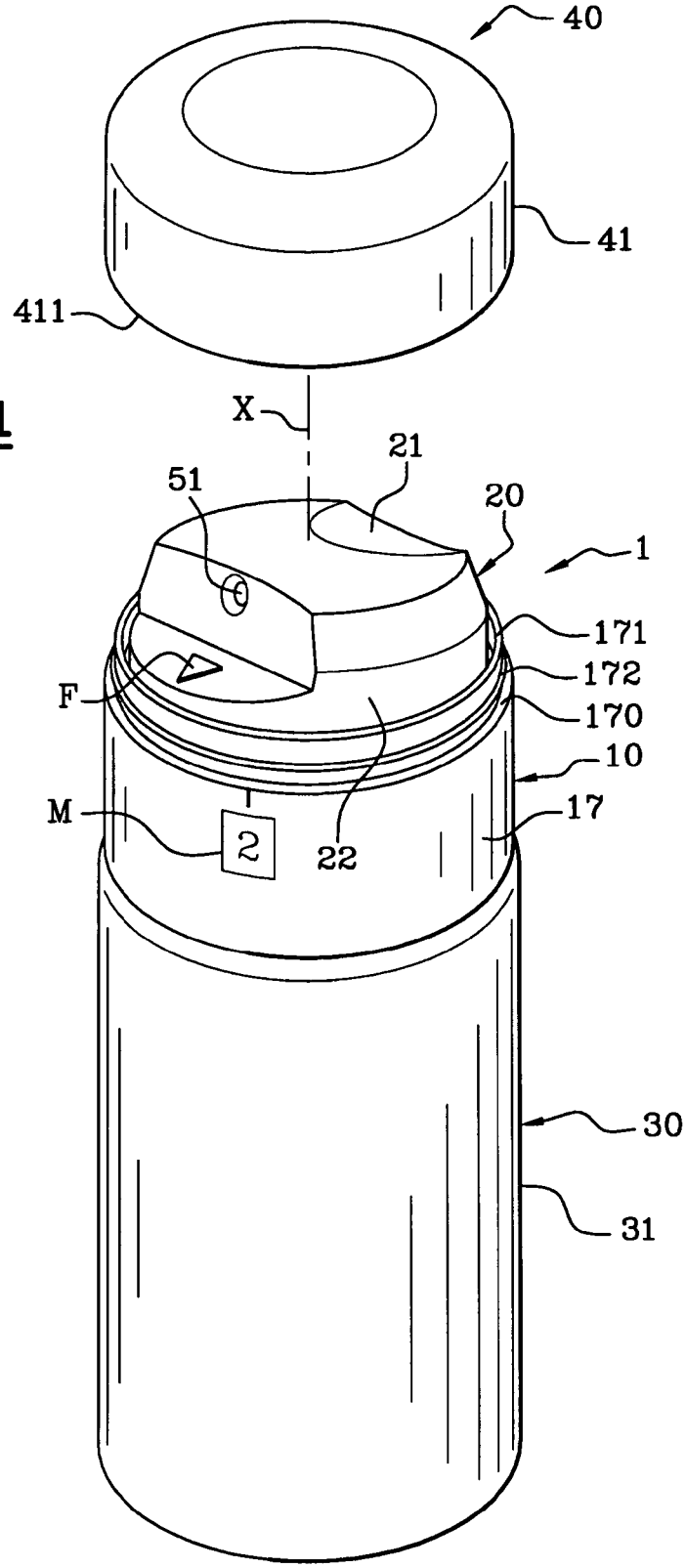
FIG. 1 is a perspective view of an embodiment of a packaging and dispensing unit fitted with a dispensing head according to the invention.
Figure 2:
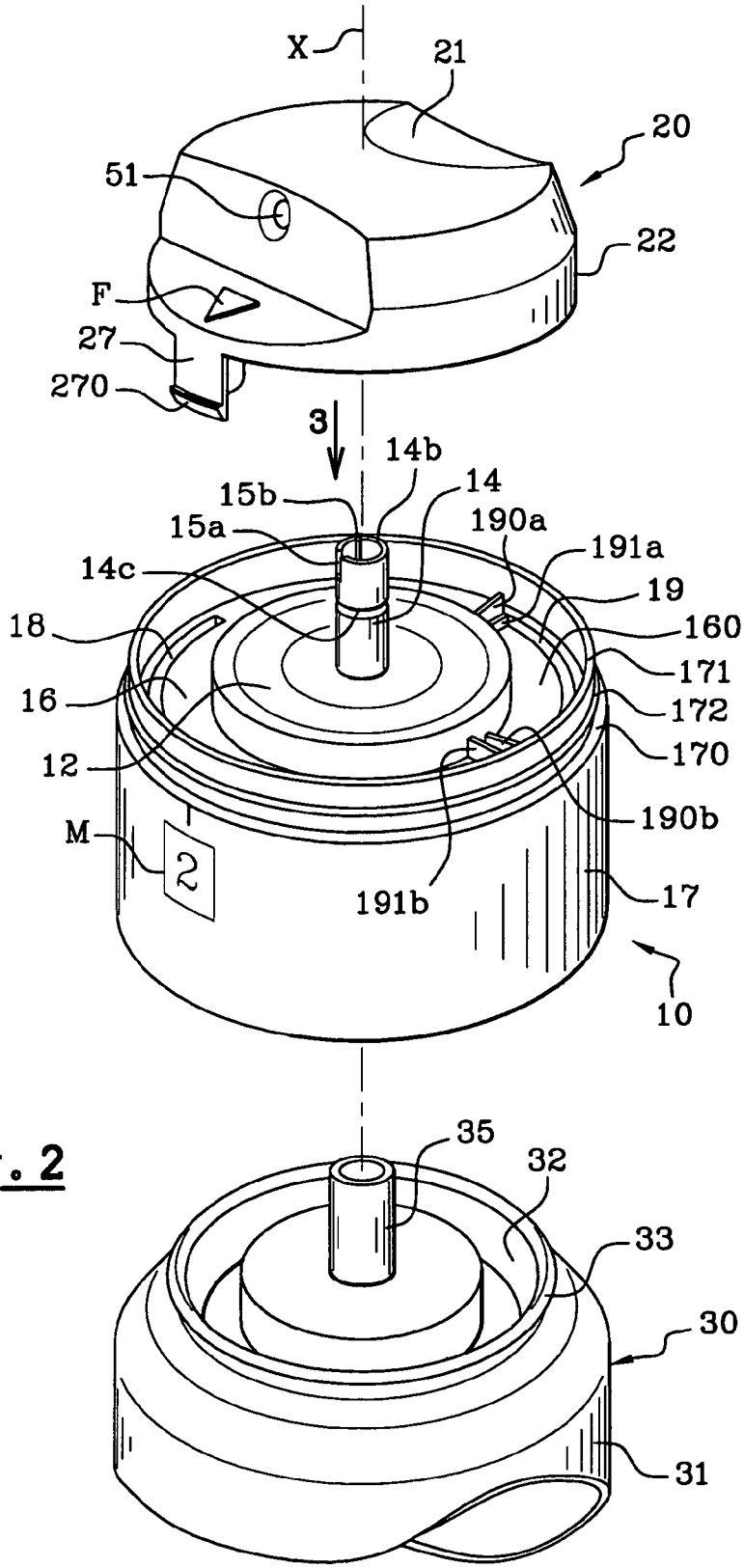
FIG. 2 is an exploded view of the embodiment illustrated in FIG. 1.

Non-limiting examples of the invention will now be described with reference to the drawing figures. It is to be understood, however, that various modifications are possible and the invention is not limited to the specific examples illustrated.

The packaging and dispensing unit illustrated in FIGS. 1 to 7 is composed of a pressurized container 30, partially illustrated in FIGS. 2, 4, 5 and 7, on which a dispensing head 1 according to the invention is attached and which can be closed by means of a cap 40. The receptacle 30 is formed by a pressurized can having an axis X, formed by a body 31 of cylindrical shape of which the upper end is closed by a collar 32 crimped onto a rolled edge 33 of the receptacle. As noted earlier, however, the container need not be pressurized. In addition, the container could have different shapes and forms.

The collar 32 is fitted with a valve 34 which includes a hollow valve stem 35 and which can be actuated, for example, by depressing the valve stem. It is evident that a valve actuated by a rocking motion of the valve stem can alternatively be used. The receptacle 30 can contain a product to be sprayed, for example a cosmetic product, and a propellant gas, which may or may not be stored in liquefied form in the receptacle 30 and which may or may not be dispensed with the product. The product thus emerges in spray form, i.e., in the form of fine particles in suspension either in the gas or in the air.

The dispensing head 1 also has an axis X and is composed of two parts (or first and second assemblies) which are movable relative to each other between two positions each enabling a product to be dispensed at a different flow-rate. The first part of the head is composed of a collar 10 to protect the valve stem and designed to be attached to the receptacle. The second part includes a push button 20 to actuate the valve and which is mobile in rotation relative to the collar. Each of the two parts is preferably obtained by molding of a thermoplastic material from a single piece.

Figure 4:
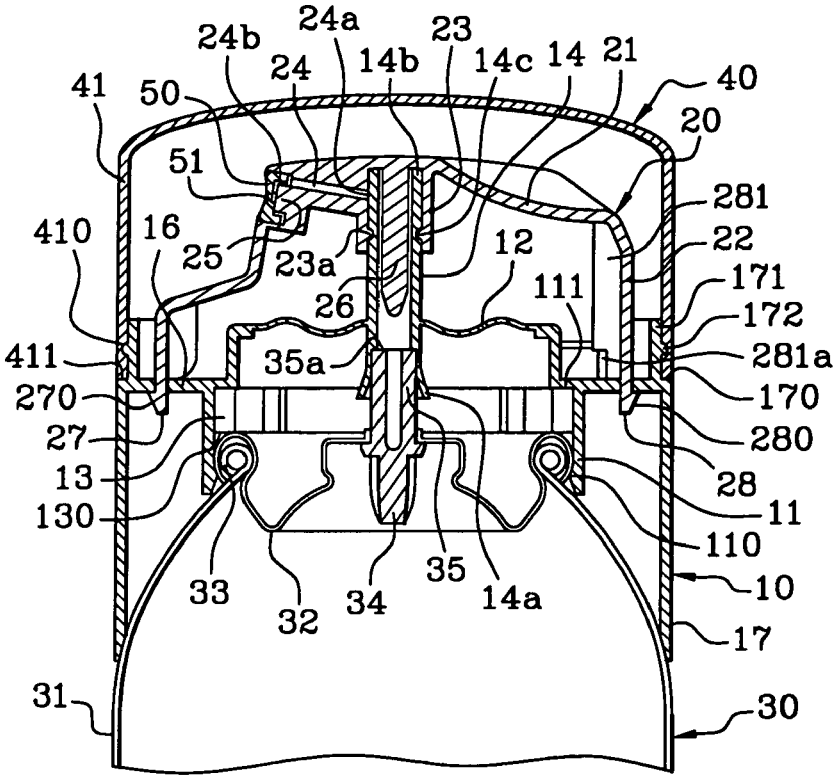
FIG. 4 shows an axial cross-section of the dispensing head in the closed position.
Figure 5:
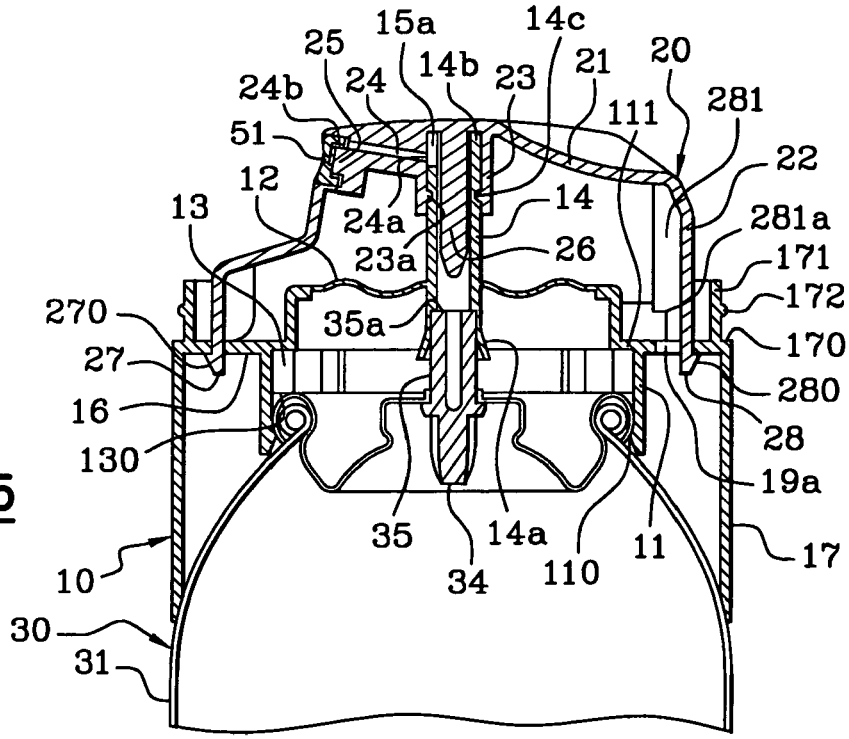
FIG. 5 shows an axial cross-section of the dispensing head in a dispensing position, with the valve not actuated.
Figure 7:
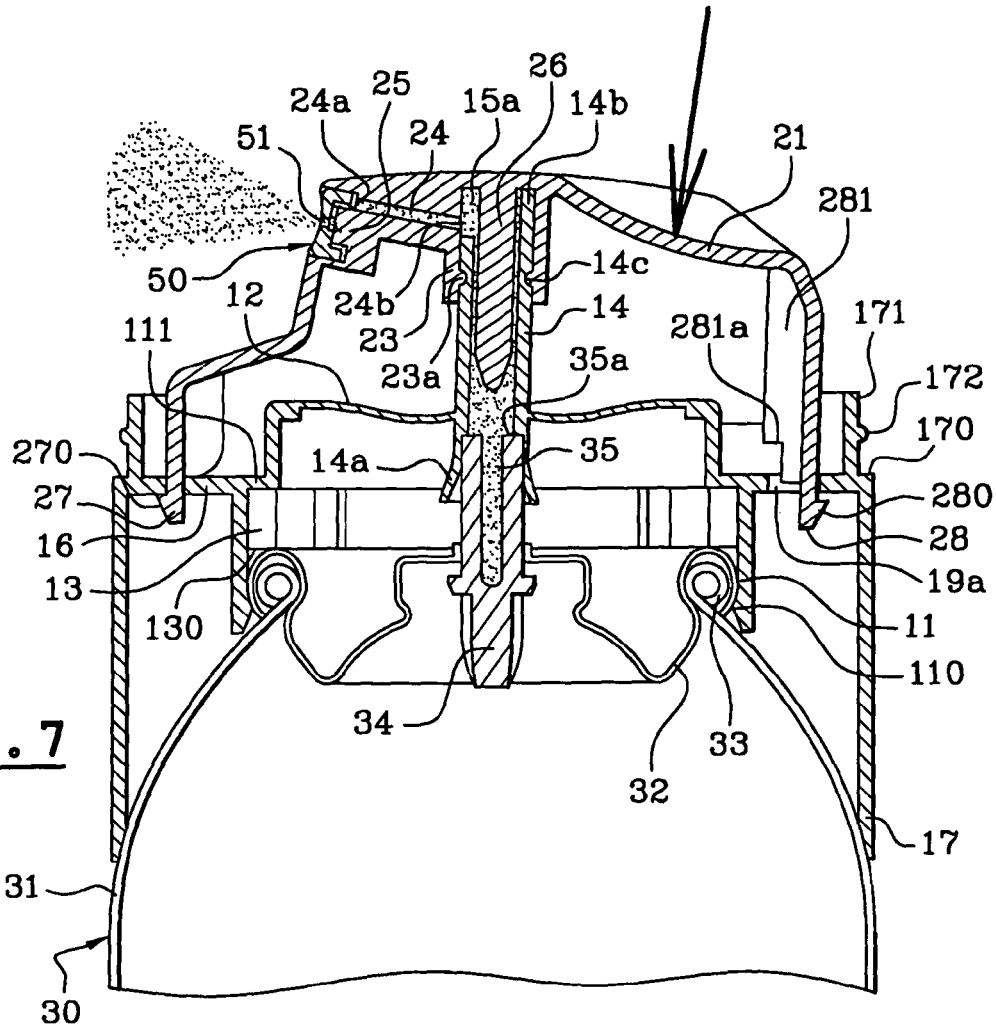
FIG. 7 shows an axial cross-section of the dispensing head in a dispensing position, with the valve actuated.

The collar 10 includes a fixing skirt 11 (see, e.g., FIGS. 4, 5 and 7) to attach the head to the receptacle. The fixing skirt 11 is fitted with an annular bead 110 on the inner wall permitting snap-on attachment to the receptacle under the rolled edge 33 of the receptacle and cup 32. The fixing skirt 11 has a radial step 111 towards the inside of the skirt and extends axially above the step to an upper extremity from which a transverse wall 12 is formed. Radial fins 13, spaced at angles around the periphery of the inner surface of the fixing skirt, extend parallel to axis X from the step 111 to a bottom free edge 130. The free edge 130 is designed to bear against the receptacle when the collar is mounted on the receptacle, as can be seen in FIGS. 4, 5 and 7. The fins 13 thus serve to limit the axial penetration of the collar when it is snapped onto the receptacle. The transverse wall 12 is a thin wall which is corrugated so as to be elastically deformable, enabling it to deform when axial load is applied to it. The wall 12 is traversed at its center by a conduit 14 formed on axis X.

The conduit 14 extends from one side of the transverse wall 12 to the other from an open lower extremity 14*a* fitted onto the valve stem 35, to an upper extremity 14*b*, also open, onto which the axial skirt 23 of the push button is fitted. An annular groove 14*c* is incorporated in the outer surface of the conduit 14 to receive an annular bead 23*a* on the inner surface of the axial skirt 23 of the push button so as to maintain the axial position of the push button on the collar. In addition, engagement of the annular bead 23*a* with the annular groove 14*c* ensures a leaktight seal between the conduit and the inside of the push button.

The conduit 14 is cylindrical in shape and defines at its lower part a recessed seating designed to engage in an effectively leaktight manner with the upper part of the valve stem 35 the upper extremity 35*a* of which bears against the recessed seat. The lower extremity 14*a* of the conduit is slightly tapered to facilitate placement of the conduit on the valve stem. The upper extremity 14*b* includes two axial slots or passages 15*a* and 15*b* (FIG. 3) of different widths which define two passages for the product of different cross-sections allowing the product to emerge at two different flow-rates. It is evident that it is possible to provide as many slots of different widths to obtain as many different flow-rates as desired. In the particular illustrated arrangement, by way of example, the two slots 15*a* and 15*b* are spaced at angles of approximately 80°.

Figure 8:
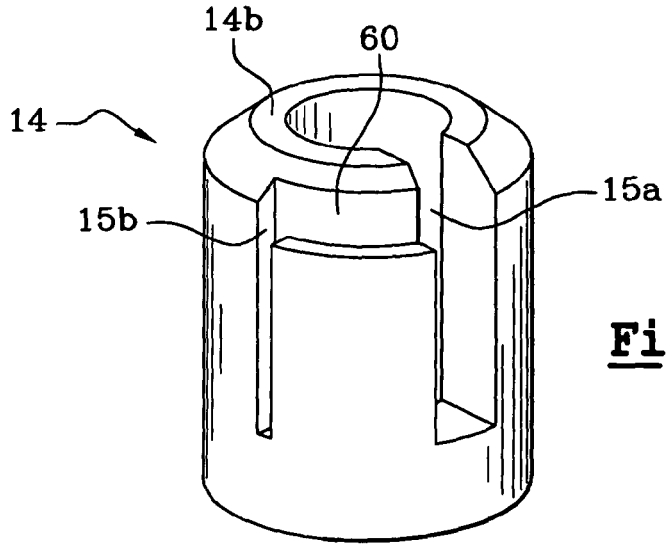
FIG. 8 shows a variant of the conduit formed on the collar of the dispensing head.

According to a variant illustrated in FIG. 8, the upper extremity 14*b* of the conduit can include a first passage 15*a* formed by a slot emerging into an aperture of larger cross-section. The upper extremity 14*b* also includes a second passage 15*b* for the product, longer than the first and terminating in a second aperture in the form of a groove of smaller cross-section than the aperture of the first passage. This groove is connected to the first slot by a step 60 formed at the upper extremity of the conduit 14. In this variant, the product emerging from conduit 14 is directed to the second aperture by part of the first slot 15*a* and by the step 60.

The fixing skirt 11 is connected in the region of the step 111 by an annular transverse wall 16 to an outer skirt 17 concentric with the fixing skirt 11. The outer skirt 17 is designed to form an extension to the receptacle wall when the dispensing head is mounted on the receptacle. Two marks M are provided on the outer surface of this skirt 17 to visually indicate the angular positions of the two slots 15*a* and 15*b*. A first mark M is, for example, the number "1" which corresponds to the position of the slot 15*b* of smaller width and which therefore allows the product to be delivered at a low flow-rate, and a second mark M is, for example, the number "2" which corresponds to the position of the wider slot 15*a* which therefore allows the product to be delivered at a higher flow-rate. The outer skirt 17 includes a shoulder 170 and extends axially above this shoulder by an axial crown 171. The crown 171 incorporates an annular bead 172 on its outer wall permitting attachment of the closure cap 40 by snapping into an annular groove 410 on the inner surface of the side wall 41 of the cap. With the cap mounted on the dispensing head, the side wall 41 of the cap forms the extension of the outer skirt 17 and the free edge 411 of the cap bears against the shoulder 170. The annular transverse wall 16 of the collar is traversed by two curved apertures 18 and 19 diametrically opposed on the annual transverse wall, formed in proximity to the outer skirt 17, and in which two lugs associated with the push button are designed to move, as will be described in detail below.

The first aperture 18 (FIG. 3) is formed on the side facing the axial slots 15*a* and 15*b* in the conduit and the second aperture 19 is formed behind the axial slots 15*a* and 15*b*. The second curved aperture 19 terminates, in proximity to each end of the curve, in two aperture portions 19*a* and 19*b* which extend aperture 19 radially inward. The aperture portions 19*a* and 19*b* are spaced at an angle of approximately 80° and are each formed respectively according to the diameter or axis passing through each to the axial slots 15*a* and 15*b*. The portion 160 of the annular transverse wall 16 situated between each aperture portion 19*a* and 19*b* serves as an axial stop for the push button as will be seen in detail below. Two vertical stops 190*a* and 190*b* border each outer edge of each aperture portion 19*a* and 19*b*, respectively. The stops 190*a* and 190*b* extend axially from the annular transverse wall 16 to an upper free edge, and extend radially from the outer surface of the fixing skirt 11 to the slot 19. The stops 190*a* and 190*b* are relatively rigid by virtue of the fact that they are integral both with the annular transverse wall 16 and the fixing skirt 11, and thus serve to limit the rotational movement of the push button. Two radial tabs 191*a* and 191*b* extend axially from the annular transverse wall 16 to one upper free edge 191*a*' and 191*b*'. They are formed on the side facing the inner edge of each aperture portion 19*a* and 19*b*. The tabs 191*a* and 191*b* extend to an axial height less than that of the stops 190*a* and 190*b* and are also narrower than the stops 190*a* and 190*b*. The tabs 191*a* and 191*b* do not extend as far as the curved aperture 19 and are set back from the fixing skirt 11 so that they are elastically deformable. The tabs 191*a* and 191*b* work in conjunction with the push button to constitute an audible means of identification to indicate that the working position has been reached. To actuate the valve, the dispensing head includes a push button 20 incorporating an upper surface 21 designed to form a bearing surface for the user's finger. The upper surface 21 is connected at its periphery to a first skirt 22 of smaller inside diameter than the diameter of the outer skirt 17 of the collar.

The push button 20 includes, inside the first skirt 22, a second skirt 23 having a cylindrical shape. The skirt 23 is centered on the axis X and fits onto the upper extremity 14*b* of the conduit 14 around which it rotates. The upper part of the skirt 23 receives, via a first extremity 24*a*, a substantially radial channel 24, the second extremity 24*b* of which terminates in a nozzle mount. In the illustrated example, the nozzle mount includes a pin 25 or "centerpost" onto which a conventional swirl-channel nozzle 50 can be attached. The nozzle 50 defines a dispensing orifice 51. An arrow F is provided on the upper surface 21 to indicate the angular position of the extremity 24*a* of the channel 24, so that when it is aligned with one or other of the marks M on the collar, the user has a visual indication of the two positions in which he/she can operate the push button to dispense the product.

A pintle 26 centered on axis X is formed inside the second skirt 23 and is inserted inside the conduit 14 when the push button is fitted on the collar. The pintle 26 has a diameter slightly smaller than that of the conduit so as to form an annular passage for the product inside the conduit. The pintle 26 serves to limit the dead volume inside the conduit and thus limit charge losses inside the conduit so as to optimize the flow-rate at which the product is released. In addition, reducing the dead volume has the effect of reducing the volume of product which the dispensing head is able to hold between the valve 34 and the dispensing orifice 51. Thus, the discharge of product spray through the dispensing orifice stops substantially at the same instant as the user releases the push button, i.e., the valve is no longer open because the quantity of product remaining inside the head is relatively small. The side skirt 22 of the push button extends axially at its lower end, at two diametrically opposite angular points, to form two lugs 27 and 28 each respectively designed to move in the curved apertures 18 and 19 in the collar.

Each lug 27 and 28 terminates at its lower end in a hook 270 and 280 which rests under the annular transverse wall 16 when the lugs 27 and 28 pass through the apertures. The hooks 270 and 280 serve to hold the push button axially on the collar. Lug 27, situated on the side where the dispensing orifice 51 is located, is designed to move in curved aperture 18. Lug 28 is designed to move in curved aperture 19. Lug 28 includes a rib 281 whose axial length and radial length are sufficient to bear against each stop 190*a* and 190*b* when the push button rotates on the collar. The rib 281 incorporates a shoulder 281 a at its lower part which enables it to stand off from the vertical edge of the tabs 191*a* and 191*b*. However, the shoulder 280*a* comes into contact with the upper free edges 191*a*' and 191*b*' of each tab 191*a* and 191*b* and elastically deforms them as it passes, as can be seen in FIG. 6, so as to produce an audible signal.

Figure 3:
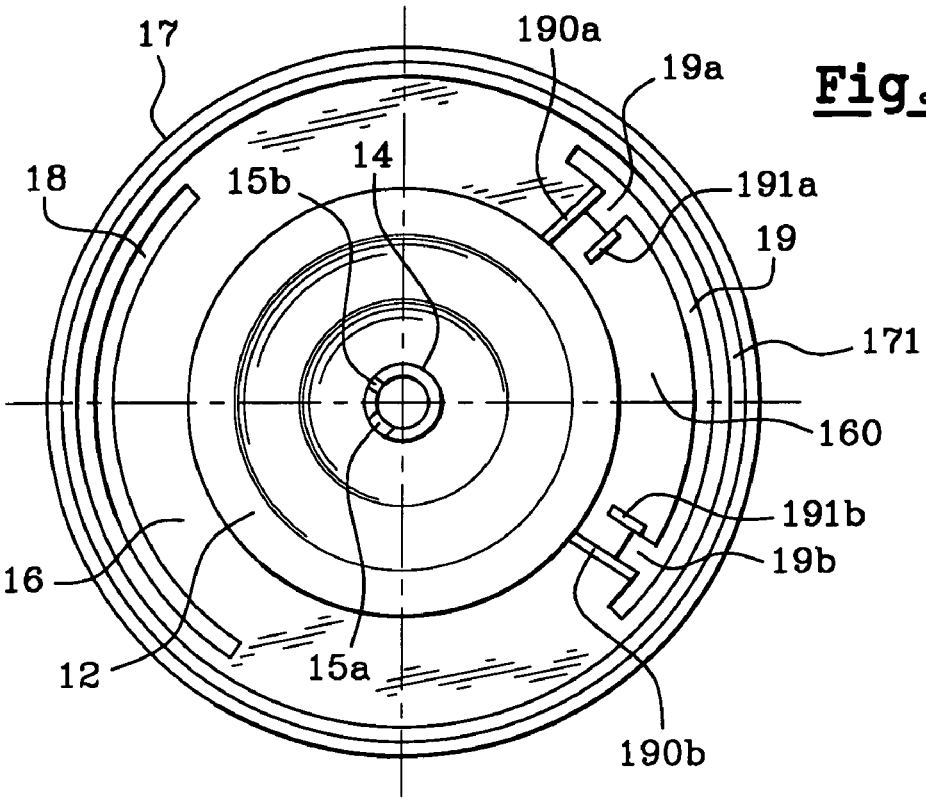
FIG. 3 shows a top view on arrow 3 of part of the dispensing head illustrated in FIG. 2.

In the storage position illustrated in FIGS. 3 and 4, the conduit 14 blocks the extremity 24*a* of the channel 24 so as to prevent any communication between the outlet orifice 51 and the inside of the dispensing conduit 24. In this position, the lug 28 passes through the slot 19 and is located between the two apertures 19*a* and 19*b*. The lower end of the rib 281 formed on the push button bears axially against the portion 160 of the annular transverse wall 16 so that if the user presses the push button 20 the latter cannot move downward and cannot therefore actuate the valve 34. To dispense the product, the user turns the push button 20 about the axis X so as to position the arrow F opposite one of the marks M. If it is wished to spray the product at a relatively high rate of flow, the mark "2" is selected so that slot 15*a* is aligned with extremity 24*a* of the channel 24. As the push button rotates, lug 27 moves in the curved aperture 18 and lug 28 moves in the curved aperture 19 until shoulder 281*a* of the rib 281 comes into contact with tab 191 *a* and, by virtue of its elasticity, moves past it to bear against stop 190*a*, emitting an audible signal indicating to the user that the push button is set at a dispensing position. In this position illustrated in FIG. 5, the rib 281 is located above aperture 19*a* and the dispensing orifice 51 is in communication with the inside of the conduit 14 via slot 15*a*.

Figure 6:
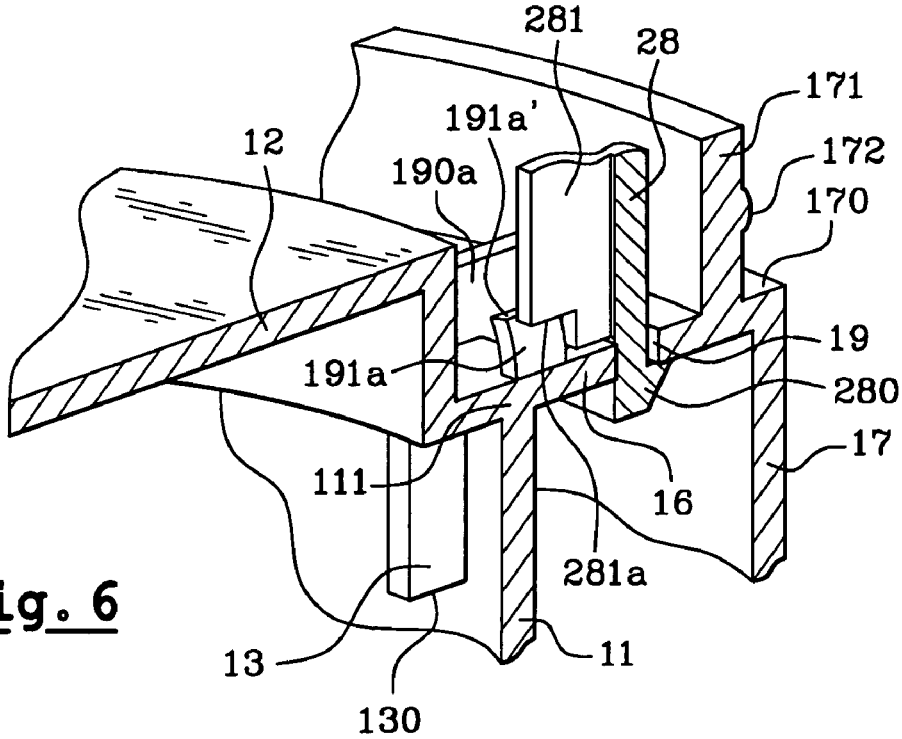
FIG. 6 shows a detail of the dispensing head on passing from the closed position to the dispensing position.

The user can then actuate the valve by pressing the push button as illustrated in FIG. 6. By pressing on the upper surface 21, the rib 281 of tab 28 enters the aperture portion 19*a* whilst tab 27 remains attached to the transverse wall 16 by virtue of the hook 270. The skirt 23 is then displaced by a movement, for example having an axial and radial component in the illustrated embodiment. This movement causes the conduit 14 on which it is mounted to move, the movement of the conduit being possible by virtue of the fact that the wall 12 deforms. The lower extremity 14*a* of the conduit in turn exerts pressure on the valve stem 35 which moves downward thereby actuating the valve 34. Product contained in the receptacle then leaves the receptacle via the interior channel of the valve stem and arrives at the dispensing orifice 51, passing through conduit 14 and channel 24. When the user releases the push button, the valve stem rises and the flow of product is interrupted.

When the user has finished using the spray, he/she turns the push button to a position between the two dispensing positions before replacing the cap 40. A third mark M, not shown, indicating this closed position can be provided between the two dispensing marks M.

In the foregoing detailed description, reference is made to preferred embodiments of the invention. It is evident that variants can be introduced thereto without departing from the spirit of the invention. Obviously, numerous modifications and variations of the present invention are possible in light of the above teachings. It is therefore to be understood that, within the scope of the appended claims, the invention may be practiced otherwise than as specifically described herein.

What is claimed as new and desired to be secured by Letters Patent of the United States is:

1. A dispensing head having an axis X, and which can actuate a dispensing element mounted on a receptacle to dispense a product contained in the receptacle, said dispensing head comprising:

a) attachment means for attaching the dispensing head onto a receptacle;

b) a dispensing conduit which can be placed in communication with the inside of the receptacle, the dispensing conduit comprising at least two passages of different cross-sections, the dispensing conduit being formed by molding as a single piece with said attachment means integral therewith via a deformable connection means; and c) actuating means for actuating the dispensing element and for causing the conduit to communicate with the inside of the receptacle, the actuating means having a dispensing orifice formed at the extremity of a channel, wherein said channel has a length greater than a diameter of the dispensing orifice, and wherein the actuating means are movable relative to the dispensing conduit between at least two positions, said at least two positions including a first position in which the dispensing orifice communicates with a first passage of the at least two passages, and a second position in which the dispensing orifice communicates with a second passage of the at least two passages.

2. A dispensing head according to claim 1, wherein the deformable connection means is elastically deformable.

3. A dispensing head according to claim 1, wherein the attachment means are mounted axially in a fixed manner on the receptacle.

4. A dispensing head according to claim 1, wherein the deformable connection means allows movement of the dispensing conduit in response to actuation of the actuating means.

5. A dispensing head according to claim 1, wherein the deformable connection means includes a transverse wall extending in a direction transverse to the axis X, and wherein the transverse wall is corrugated.

6. A dispensing head according to claim 1, wherein the dispensing conduit includes a first extremity capable of engaging with the dispensing element of the receptacle.

7. A dispensing head according to claim 6, wherein the dispensing conduit includes a second extremity onto which the actuating means are fitted.

8. A dispensing head according to claim 7, wherein the dispensing conduit is positioned on the axis X when the dispensing head is mounted onto the receptacle.

9. A dispensing head according to claim 8, wherein a pintle is positioned inside the dispensing conduit so as to define an annular passage for the product over at least part of the dispensing conduit.

10. A dispensing head according to claim 1, wherein the dispensing conduit is positioned on the axis X when the dispensing head is mounted onto the receptacle.

11. A dispensing head according to claim 1, wherein a pintle is positioned inside the dispensing conduit so as to define an annular passage for the product over at least part of the dispensing conduit.

12. A dispensing head according to claim 1, wherein the at least two passages are slots extending parallel to the axis X, said slots having different widths.

13. A dispensing head according to claim 1, wherein the actuating means are movable in rotation about the axis X between the first and second positions.

14. A dispensing head according to claim 13, wherein the dispensing head is configured so as to allow the dispensing element to be actuated only when the actuating means are in the first and second positions.

15. A dispensing head according to claim 1, wherein the dispensing head is configured so as to allow the dispensing element to be actuated only when the actuating means are in the first and second positions.

16. A dispensing head according to claim 15, wherein the dispensing head includes an axial stop against which the actuating means bear when not in either of the first or second positions so as to prevent actuation of the dispensing element.

17. A dispensing head according to claim 16, further including at least two radial stops limiting the rotational movement of the actuating means.

18. A dispensing head according to claim 15, further including at least two radial stops limiting the rotational movement of the actuating means.

19. A dispensing head according to claim 18, further including means for audible identification to indicate positioning in either of the first and second positions.

20. A dispensing head according to claim 1, further including means for audible identification to indicate positioning in either of the first and second positions.

21. A dispensing head according to claim 20, wherein the means for audible identification provide audible identification by the engagement of a first projection formed on the actuating means and a second projection integral with the dispensing conduit, the first projection being capable, when the actuating means move relative to the conduit, of making contact with the second projection and elastically deforming the latter as it passes across it, thereby producing an audible signal.

22. A dispensing head according to claim 21, further including means for visual identification to identify the first and second positions.

23. A dispensing head according to claim 1, further including means for visual identification to identify the first and second positions.

24. A packaging and dispensing unit for a product, including:

a receptacle containing the product and fitted with a dispensing element mounted on the receptacle; and a dispensing head having an axis X and which can actuate the dispensing element mounted on the receptacle to dispense the product contained in the receptacle, said dispensing head comprising:

a) attachment means for attaching the dispensing head onto a receptacle;

b) a dispensing conduit which can be placed in communication with the inside of the receptacle, the dispensing conduit comprising at least two passages of different cross-sections, the dispensing conduit being formed by molding as a single piece with said attachment means integral therewith via a deformable connection means; and c) actuating means for actuating the dispensing element and for causing the conduit to communicate with the inside of the receptacle, the actuating means having a dispensing orifice formed at the extremity of a channel, wherein said channel has a length greater than a diameter of the dispensing orifice, and wherein the actuating means are movable relative to the dispensing conduit between at least two positions, said at least two positions including a first position in which the dispensing orifice communicates with a first passage of the at least two passages, and a second position in which the dispensing orifice communicates with a second passage of the at least two passages.

25. A packaging and dispensing unit according to claim 24, wherein the receptacle is pressurized and the dispensing element is a valve.

26. A packaging and dispensing unit according to claim 25, wherein the dispensing conduit is fitted onto a valve stem of the valve.

27. A packaging and dispensing unit according to claim 24, wherein the product in said receptacle is one of a cosmetic and a personal care product.

28. A packaging and dispensing unit according to claim 24, wherein the product in said receptacle is a hair product.

29. A dispensing head having an axis X, and which can actuate a dispensing element mounted on a receptacle to dispense a product contained in the receptacle, said dispensing head comprising:

a) attachment means for attaching the dispensing head onto the receptacle;

b) a dispensing conduit which can be placed in communication with the inside of the receptacle, comprising at least two passages of different cross-sections, the dispensing conduit being formed by molding as a single piece with said attachment means integral therewith via a deformable connection means; and c) actuating means for actuating the dispensing element and for causing the conduit to communicate with the inside of the receptacle, the actuating means having a dispensing orifice defined by an attached nozzle, wherein the actuating means are movable relative to the dispensing conduit between at least two positions, a first position in which the dispensing orifice communicates with a first passage of the at least two passages, and a second position in which the dispensing orifice communicates with a second passage of the at least two passages.

30. A packaging and dispensing unit for a product comprising:

a receptacle within which the product is provided, said receptacle including a dispensing element through which the product flows when dispensed;

a first assembly mounted to said receptacle, said first assembly including a conduit having one end coupled to said dispensing element of said receptacle, said conduit including a second end having at least two passages of different cross-sections, and wherein said first assembly includes a fixed portion which is substantially fixed with respect to the receptacle, the first assembly further including a movable portion which is movable relative to said receptacle, and wherein said conduit is coupled to said movable portion such that upon application of force to said conduit said conduit is movable to move said dispensing element to dispense product through said dispensing element and through said conduit;

a second assembly mounted to said first assembly, wherein said second assembly is movable relative to said fixed portion of said first assembly in a first direction, and wherein a portion of said second assembly engages said conduit during movement is said first direction to apply a force to said conduit to dispense the product, and further wherein said second assembly includes a channel and an outlet orifice at one end of said channel, and wherein the product exits said packaging and dispensing unit through said outlet orifice, and further wherein another end of said channel is in selective communication with one said at least two passages of said conduit of said first assembly, and said second assembly is rotatable with respect to said first assembly to determine which passage of the at least two passages of said conduit establishes selective communication with said channel.

31. A packaging and dispensing unit according to claim 30, wherein said movable portion of said first assembly is elastically movable whereby application of a force to said second assembly to move said second assembly in said first direction causes said product to be dispensed and upon cessation of the application of the force the movable portion of the first assembly causes a return movement of the second assembly and dispensing of the product is halted.

32. A packaging and dispensing unit according to claim 30, wherein said channel of said second assembly has a length larger than a diameter of said outlet orifice of said second assembly.

33. A packaging and dispensing unit according to claim 30, wherein said first assembly is formed as a one piece molded part.

34. A packaging and dispensing unit according to claim 30, wherein said second assembly is formed as a one piece molded part.

35. A packaging and dispensing unit according to claim 34, wherein said first assembly is formed as a one piece molded part.

36. A packaging and dispensing unit according to claim 30, wherein said fixed portion of said first assembly includes an inner skirt snap fastened to said receptacle, and wherein said first assembly further includes an outer skirt surrounding said inner skirt.

37. A packaging and dispensing unit according to claim 36, wherein said receptacle includes an axis X, and wherein said movable portion of said first assembly includes an elastically deformable wall extending in a direction transverse to the axis X.

38. A packaging and dispensing unit according to claim 30, wherein said receptacle includes an axis X, and wherein said movable portion of said first assembly includes an elastically deformable wall extending in a direction transverse to the axis X.

39. A packaging and dispensing unit according to claim 30, wherein the product in said receptacle is one of a cosmetic and a personal care product.

40. A packaging and dispensing unit according to claim 30, wherein the product in said receptacle is a hair product.

41. A packaging and dispensing unit according to claim 30, wherein said second assembly includes a push button surface upon which a user presses to dispense the product.

42. A packaging and dispensing unit according to claim 30, wherein said second assembly includes a pintle which extends into a portion of said conduit of said first assembly.

43. A packaging and dispensing unit according to claim 30, wherein said first assembly includes at least one arcuate slot and said second assembly includes at least one lug which extends into said at least one arcuate slot, and wherein said second assembly is movable in said first direction relative to said first assembly as the amount by which said at least one lug extends through said at least one arcuate slot is varied, and further wherein second assembly is rotatable relative to said first assembly as a position of said at least one lug along said at least one arcuate slot is varied.

44. A packaging and dispensing unit according to claim 43, further including means for restraining movement of said second assembly in said first direction when said channel is not aligned with a passage of said at least two passages of said conduit.

45. A packaging and dispensing unit according to claim 44, further including means for audibly indicating alignment of said channel with a passage of said at least two passages.

46. A packaging and dispensing unit according to claim 30, further including means for audibly indicating alignment of said channel with a passage of said at least two passages.

47. A packaging and dispensing unit according to claim 30, further including means for restraining movement of said second assembly in said first direction when said channel is not aligned with a passage of said at least two passages of said conduit.

48. A packaging and dispensing unit according to claim 30, further including means to visually indicate alignment of said channel with a passage of said at least two passages.

49. A packaging and dispensing unit according to claim 30, wherein said first assembly includes an outer skirt that forms an extension of said receptacle when said first assembly is mounted to said receptacle.

50. A packaging and dispensing unit according to claim 49, wherein said first assembly further includes a portion disposed above said outer skirt and having a diameter smaller than said outer skirt, the unit further including a cap which snap fits onto said portion disposed above said outer skirt, and wherein said cap forms an extension of said receptacle and said outer skirt.

51. A packaging and dispensing unit according to claim 50, wherein part of said second assembly is received inside of said portion of said first assembly disposed above said outer skirt.

* * * * *